US006781100B2

(12) United States Patent
Pilavdzic et al.

(10) Patent No.: US 6,781,100 B2
(45) Date of Patent: Aug. 24, 2004

(54) METHOD FOR INDUCTIVE AND RESISTIVE HEATING OF AN OBJECT

(75) Inventors: James Pilavdzic, Milton, VT (US); Stefan Von Buren, Colchester, VT (US); Valery G. Kagan, Colchester, VT (US)

(73) Assignee: Husky Injection Molding Systems, Ltd., Bolton (CA)

( * ) Notice: Subject to any disclaimer, the term of this patent is extended or adjusted under 35 U.S.C. 154(b) by 0 days.

(21) Appl. No.: 09/891,826

(22) Filed: Jun. 26, 2001

(65) Prior Publication Data

US 2003/0000945 A1 Jan. 2, 2003

(51) Int. Cl.[7] ..... H05B 6/14

(52) U.S. Cl. ..... 219/601; 219/628; 219/630; 219/672

(58) Field of Search ..... 219/601, 628, 219/629, 630, 656, 660, 635, 672, 674

(56) References Cited

U.S. PATENT DOCUMENTS

| | | | | |
|---|---|---|---|---|
| 1,771,918 A | * | 7/1930 | Fry | 219/628 |
| 2,163,993 A | * | 6/1939 | Dufour et al. | 219/601 |
| 3,440,384 A | | 4/1969 | Schroeder | 219/10.49 |
| 3,708,645 A | * | 1/1973 | Osborn, Jr. | 219/601 |
| 3,989,916 A | | 11/1976 | Amagami et al. | 219/10.49 |
| 4,256,945 A | | 3/1981 | Carter et al. | 219/10.75 |
| 4,521,659 A | | 6/1985 | Buckley et al. | 219/10.77 |
| 4,599,061 A | | 7/1986 | Manabe et al. | 425/41 |
| 4,726,751 A | | 2/1988 | Shibata et al. | 425/144 |
| 4,788,394 A | | 11/1988 | Vanneste et al. | 219/10.61 R |
| 4,798,926 A | * | 1/1989 | Sakai | 219/670 |
| 4,814,567 A | * | 3/1989 | De Angelis et al. | 219/628 |
| 4,874,916 A | | 10/1989 | Burke | 219/10.75 |
| 4,940,870 A | | 7/1990 | Shibata et al. | 219/10.491 |
| 5,061,415 A | | 10/1991 | Depcik | 264/25 |
| 5,061,835 A | | 10/1991 | Iguchi | 219/10.79 |
| 5,176,839 A | | 1/1993 | Kim | 249/78 |
| 5,216,215 A | * | 6/1993 | Walker et al. | 219/630 |
| 5,315,085 A | | 5/1994 | Ferguson | 219/50 |
| 5,439,047 A | | 8/1995 | Eckert | 164/471 |
| 5,444,229 A | * | 8/1995 | Rudolph et al. | 219/630 |
| 5,461,215 A | | 10/1995 | Haldeman | 219/677 |
| 5,547,717 A | | 8/1996 | Scaringella et al. | 427/590 |
| 5,571,436 A | | 11/1996 | Gregg et al. | 219/604 |
| 5,580,479 A | | 12/1996 | Bruns | 219/616 |
| 5,762,972 A | | 6/1998 | Byon | 425/144 |
| 5,799,720 A | | 9/1998 | Ross et al. | 164/471 |
| 5,973,296 A | | 10/1999 | Juliano et al. | 219/424 |
| 5,979,506 A | | 11/1999 | Aarseth | 138/33 |

FOREIGN PATENT DOCUMENTS

| | | |
|---|---|---|
| EP | 1 006 757 A2 | 7/2000 |
| FR | 1456221 | 5/1966 |
| GB | 772424 | 4/1957 |
| JP | 1996-8051 | 1/1996 |
| WO | WO 98/00274 | 1/1998 |

OTHER PUBLICATIONS

"Design News" magazine dated Sep. 26, 1994 pp. 109–110 article titled "Litz Wire Boosts Induction Heater's Efficiency".

"Industrial Heating" magazine dated Apr. 1994 article titled "Radio Frequency Heating Using Litz Wire Technology for Semiconductor Wafer Processing" by Charles Haldeman and Brian Ahern.

PCT International Search Report for International Appln. No. PCT/CA 02/00534 dated Aug. 1, 2002.

* cited by examiner

*Primary Examiner*—Philip H. Leung
(74) *Attorney, Agent, or Firm*—Katten Muchin Zavis Rosenman

(57) ABSTRACT

A method and apparatus for temperature control of an article is provided that utilizes both the resistive heat and inductive heat generation from a heater coil.

13 Claims, 7 Drawing Sheets

| Design Criteria | Inductive Heater | Resistive Heater | Combo Heater |
|---|---|---|---|
| Placement of Coil | Spaced away from heated article. | Wrapped around heated article. | Placed inside grooves of heated article to provide closed magnetic path. |
| Coil Resistance | Low (ie. Cu) | High (ie. NiCr) | High (ie. NiCr) |
| Thermal Communication of Coil with Heated Article | No – coil heat is removed by special cooling. | Yes – coil heat is conducted to article. | Yes – heat is conducted to article and no special cooling required. |
| Power Supply Characteristics | High Frequency – resonance filter required. | Line Frequency – no filter required. | High frequency – no resonance filter required. |
| Max. Heating Power | $P_I = I^2_{I(max)} \times R_{eq}$ | $P_I = I^2_{R(max)} \times R_R$ | $P_{combo(max)} = P_{R(max)} + P_{I(max)}$ |
| Min. Time of Heating | $t_{I(min)} = (cM\Delta T)/P_{I(max)}$ | $t_{R(min)} = (cM\Delta T)/P_{R(max)}$ | $t_{combo(min)} = (cM\Delta T)/(P_{R(max)} + P_{I(max)})$ |
| Coil Energy Losses | $P_{I(loss)} = (I^2_{I(max)} R_c) + P_{(cool\ sys)}$ | $P_{R(loss)} = 0$ | $P_{combo(loss)} = 0$ |

| Design Criteria | Inductive Heater (FIG. 2) | Resistive Heater (FIG. 1) | Combo Heater (FIG. 3) |
|---|---|---|---|
| Placement of Coil | Spaced away from heated article. | Wrapped around heated article. | Placed inside grooves of heated article to provide closed magnetic path. |
| Coil Resistance | Low (ie. Cu) | High (ie. NiCr) | High (ie. NiCr) |
| Thermal Communication of Coil with Heated Article | No – coil heat is removed by special cooling. | Yes – coil heat is conducted to article. | Yes – heat is conducted to article and no special cooling required. |
| Power Supply Characteristics | High Frequency – resonance filter required. | Line Frequency – no filter required. | High frequency – no resonance filter required. |
| Max. Heating Power | $P_I = I^2_{I(max)} \times R_{eq}$ | $P_I = I^2_{R(max)} \times R_R$ | $P_{combo(max)} = P_{R(max)} + P_{I(max)}$ |
| Min. Time of Heating | $t_{I(min)} = (cM\Delta T)/P_{I(max)}$ | $t_{R(min)} = (cM\Delta T)/P_{R(max)}$ | $t_{combo(min)} = (cM\Delta T)/(P_{R(max)} + P_{I(max)})$ |
| Coil Energy Losses | $P_{I(loss)} = (I^2_{I(max)} R_c) + P_{(cool\ sys)}$ | $P_{R(loss)} = 0$ | $P_{combo(loss)} = 0$ |

FIG. 5

METHOD FOR INDUCTIVE AND RESISTIVE HEATING OF AN OBJECT

BACKGROUND OF THE INVENTION

This invention relates to an apparatus and method for controlling the temperature of an object, for example, heating an object. More particularly, this invention relates to the apparatus and method for improved performance of heating by combining the inductive and resistive heating produced by a heater.

Referring to FIG. 1, a typical resistive heater circuit 10 in accordance with the prior art is shown. A power supply 12 may provide a DC or AC voltage, typically line frequency to a heater coil 14 which is wrapped around in close proximity to a heated article 20. Typically, the heater coil 14 is made up of an electrically resistive element with an insulation layer 18 applied to prevent it from shorting out. It is also common to have the entire heater coil encased in a cover 16 to form a modular heating subassembly. The prior art is replete with examples of ways to apply heat to material and raise the temperature of the heated article 20 to a predetermined level. Most of these examples center around the use of resistive or ohmic heat generators that are in mechanical and thermal communication with the article to be heated.

Resistive heaters are the predominate method used today. Resistive heat is generated by the ohmic or resistive losses that occur when current flows through a wire. The heat generated in the coil of the resistive type heater must then be transmitted to the workpice by conduction or radiation. The use and construction of resistive heaters is well known and in most cases is easier and cheaper to use than inductive heaters. Most resistive heaters are made from helically wound coils, wrapped onto a form, or formed into sinuous loop elements.

A typical invention using a resistive type heater can be found in U.S. Pat. No. 5,973,296 to Juliano et al. which teaches a thick film heater apparatus that generates heat through ohmic losses in a resistive trace that is printed on the surface of a cylindrical substrate. The heat generated by the ohmic losses is transferred to molten plastic in a nozzle to maintain the plastic in a free flowing state. While resistive type heaters are relatively inexpensive, they have some considerable drawbacks. Close tolerance fits, hot spots, oxidation of the coil and slower heat up times are just a few. For this method of heating, the maximum heating power can not exceed $P_{R(max)}=(I_{R(max)})^2{}_xR_c$, where $I_{R(max)}$ is equal to the maximum current the resistive wire can carry and $R_c$ is the resistance of the coil. In addition, minimum time to heat up a particular article is governed by $t_{R(min)}=(cM\Delta T)/P_{R(max)}$, where c is the specific heat of the article, M is the mass of the article and $\Delta T$ is the change in temperature desired. For resistive heating, total energy losses at the heater coil is essentially equal to zero because all of the energy from the power supply that enters the coil is converted to heat energy, therefore $P_{R(losses)}=0$.

Now referring to FIG. 2, a typical induction heating circuit 30 according to the prior art is shown. A variable frequency AC power supply 32 is connected in parallel to a tuning capacitor 34. Tuning capacitor 34 makes up for the reactive losses in the load and minimizes any such losses. Induction heater coil 36 is typically comprised of a hollow copper tube, having an electrically insulating coating 18 applied to its outer surface and a cooling fluid 39 running inside the tube. The cooling fluid 39 is communicated to a cooling system 38 to remove heat away from the induction heater coil 36. The heater coil 36 is not generally in contact with the article to be heated 20. As the current flows through the coil 36, lines of magnetic flux are created as depicted by arrows 40*a* and 40*b*.

Induction heating is a method of heating electrically conducting materials with alternating current (AC) electric power. Alternating current electric power is applied to an electrical conducting coil, like copper, to create an alternating magnetic field. This alternating magnetic field induces alternating electric voltages and current in a workpiece that is closely coupled to the coil. These alternating currents generate electrical resistance losses and thereby heat the workpiece. Therefore, an important characteristic of induction heating is the ability to deliver heat into electrical conductive materials without direct contact between the heating element and the workpiece.

If an alternating current flows through a coil, a magnetic field is produced that varies with the amount of current. If an electrically conductive load is placed inside the coil, eddy currents will be induced inside the load. The eddy currents will flow in a direction opposite to the current flow in the coil. These induced currents in the load produce a magnetic field in the direction opposite to the field produced by the coil and prevent the field from penetrating to the center of the load. The eddy currents are therefore concentrated at the surface of the load an decrease dramatically towards the center. As shown in FIG. 3A, the induction heater coil 36 is wrapped around a cylindrical heated body 20. The current density $J_x$ is shown by line 41 of the graph. As a result of this phenomenon, almost all the current is generated in the area 22 of the cylindrical heated body 20, and the material 24 contained central to the heated body is not utilized for the generation of heat. This phenomenon is often referred to as "skin effect".

Within this art, the depth where current density in the load drops to a value of 37% of its maximum is called the penetration depth ($\delta$). As a simplifying assumption, all of the current in the load can be safely assumed to be within the penetration depth. This simplifying assumption is useful in calculating the resistance of the current path in the load. Since the load has inherent resistance to current flow, heat will be generated in the load. The amount of heat generated (Q) is a function of the product of resistance (R) and the eddy current (I) squared and time (t), $Q=I^2Rt$.

The depth of penetration is one of the most important factors in the design of an induction heating system. The general formula for depth of penetration $\delta$ is given by:

$$\delta = \sqrt{\frac{\rho}{\pi\mu\mu_\upsilon f}}$$

where $\mu_\upsilon$=magnetic permeability of a vacuum $\mu$=relative magnetic permeability of the load $\rho$=resistivity of the load $f$=frequency of alternating current Thus, the depth of penetration is a function of three variables, two of which are related to the load. The variables are the electrical resistivity of the load, the magnetic permeability of the load, and the frequency $\eta$ of the alternating current in the coil. The magnetic permeability of a vacuum is a constant equal to $4\times10^{-7}$ (Wb/A m).

A major reason for calculating the depth of penetration is to determine how much current will flow within the load of a given size. Since the heat generated is related to the square of the eddy current ($I^2$), it is imperative to have as large a current flow in the load as possible.

In the prior art, induction heating coils are almost exclusively made of hollow copper tubes with water cooling running therein. Induction coils, like resistive heaters, exhibit some level of resistive heat generation. This phenomenon is undesirable because as heat builds in the coil it effects all of the physical properties of the coil and directly impacts heater efficiency. Additionally, as heat rises in the coil, oxidation of the coil material increases and this severely limits the life of the coil. This is why the prior art has employed means to draw heat away from the induction coil by use of a fluid transfer medium. This unused heat, according to the prior art, is wasted heat energy which lowers the overall efficiency of the induction heater. In addition, adding active cooling means like flowing water to the system greatly increases the system's cost and reduces reliability. It is therefore advantageous to find a way to utilize the resistive heat generated in an induction coil which will reduce overall heater complexity and increases the system efficiency.

According to the prior art, various coatings are used to protect the coils from the high temperature of the heated workpiece and to provide electrical insulation. These coatings include cements, fiberglass, and ceramics.

Induction heating power supplies are classified by the frequency of the current supplied to the coil. These systems can be classified as line-frequency systems, motor-alternating systems, solid-state systems and radio-frequency systems. Line-frequency systems operate at 50 or 60 Hz which is available from the power grid. These are the lowest cost systems and are typically used for the heating of large billets because of the large depth of penetration. The lack of frequency conversion is the major economic advantage to these systems. It is therefore advantageous to design an induction heating system that will use line frequencies efficiently, thereby reducing the overall cost of the system.

U.S. Pat. No. 5,799,720 to Ross et al. shows an inductively heated nozzle assembly for the transferring of molten metal. This nozzle is a box-like structure with insulation between the walls of the box and the inductive coil. The molten metal flowing within the box structure is heated indirectly via the inductive coil.

U.S. Pat. No. 4,726,751 to Shibata et al. discloses a hot-runner plastic injection system with tubular nozzles with induction heating windings wrapped around the outside of the nozzle. The windings are attached to a high frequency power source in series with one another. The tubular nozzle itself is heated by the inductive coil which in turn transfers heat to the molten plastic.

U.S. Pat. No. 5,979,506 to Aarseth discloses a method and system for heating oil pipelines that employs the use of heater cables displaced along the periphery of the pipeline. The heater cables exhibit both resistive and inductive heat generation which is transmitted to the wall of the pipeline and thereby to the contents in the pipeline. This axial application of the electrical conductors is being utilized primarily for ohmic heating as a resistor relying on the inherent resistance of the long conductors (>10 km). Aarseth claims that some inductive heating can be achieved with varying frequency of the power supply from 0–500 Hz.

U.S. Pat. No. 5,061,835 to Iguchi discloses an apparatus comprised of a low frequency electromagnetic heater utilizing low voltage electrical transformer with short circuit secondary. Arrangement of the primary coil, magnetic iron core and particular design of the secondary containment with prescribed resistance is the essence of this disclosure. The disclosure describes a low temperature heater where conventional resinous molding compound is placed around primary coil and fills the space between iron core and secondary pipe.

U.S. Pat. No. 4,874,916 to Burke discloses a structure for induction coil with a multi-layer winding arranged with transformer means and magnetic core to equalize the current flow in each winding throughout the operational window. Specially constructed coil is made from individual strands and arranged in such a way that each strand occupies all possible radial positions to the same extent.

There exists a need however for an improved heating method that utilizes both the inductive and resistive heat generated from a heating coil and a method to reduce or eliminate leakage flux and locate the coil inside the heating apparatus to produce optimal use of the heat generated therein.

SUMMARY OF THE INVENTION

It is therefore an object of the present invention to provide an improved heater apparatus that utilizes both inductive and resistive heat energy generated by a heater coil.

Another object of the present invention is to provide a method for improving the efficiency of a heater by placing the heater coil in an optimal location that maximizes the use of the inductive and resistive heat generated by the heater coil.

Still another object of the present invention is to provide a heater that allows for quicker heat-up time for a given article.

Yet another object of the present invention is to provide a heater that utilizes induction heating that requires no internal cooling of the induction heater coil.

Still another object of the present invention is to provide a method for heating that allows the design of the heater coil to match a given power supply to provide the thermal energy required for a particular application.

Yet another object of the present invention is to provide a method for heating that allows the heat generated by induction or resistance within the same coil to be variable based on the specific application.

Still another object of the present invention is to provide an induction heating method that substantially reduces or eliminates the electromagnetic noise from the heater coil.

Yet another object of the present invention is to provide a heater that exhibits accurate temperature control.

Yet another object of the present invention to provide a method of heating that deliver almost 100% of energy from power supply to the heated article and thereby obviating the need for a tuning capacitor.

Yet another object of the present invention is to provide a method of heating where the same current through the coil provides a higher rate of heating because both resistive and inductive heating is used.

Yet another object of the present invention is to provide a heating method where induction coil cooling is not required.

Still another object of the present invention is to provide a heating method that improves temperature distribution within the heated article and therefore reduces thermal gradients.

Further object of this invention is to provide heating means with improved thermal communication of the coil and the heated article.

Yet another object of this invention is to provide a heating method that uses a power supply with variable frequency controllable by the process controller and it is independent of the resonant frequency requirements of the induction coil, but rather is variable to regulate heat output of the coil.

A further object of this invention is to provide compact heater with variable resistive and/or inductive heat output where a prior art resistive heater would be too large.

Still another object of this invention is to provide a heating means for multiple heated zones where inductively generated energy may be used in the multiplexing mode (one at the time to avoid induction coil interference between two coils), while resistively generated energy in the same coil can be used to maintain temperature set point while inductive heating is minimized to levels that is suitable for simultaneous coil operation. This may be accomplished by use of the variable frequency power supply, where frequency of the supplied current can be lowered to reduce inductive coupling within same heated object.

Yet another object of the present invention is to provide a heating method that improves inductive coupling between heater coil and heated article to be almost 100% with almost no leakage inductance.

To this end, the present invention provides a heating method and apparatus which utilizes a specifically adapted induction heater coil embedded within an electrically conductive and/or a ferromagnetic substrate. The placement in the substrate is based on an analytical analysis of the heater design and results in an optimal location that provides a maximum of usable heat generation. The heater coil within the substrate will generate both resistive and inductive heat that will be directed towards the article or medium to be heated.

BRIEF DESCRIPTION OF THE DRAWINGS

FIG. 5 is a table comparing design criteria of resistive heating, inductive heating and the heating method in accordance with the present invention.

DETAILED DESCRIPTION OF THE PREFERRED EMBODIMENT

Figure 1:
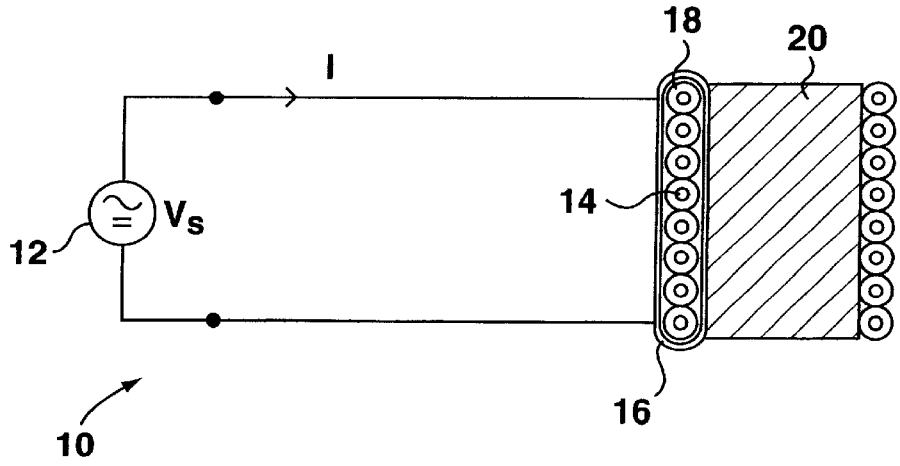
FIG. 1 (PRIOR ART)
FIG. 1 is a simplified schematic representation of resistive heating as known in the art.
Figure 2:
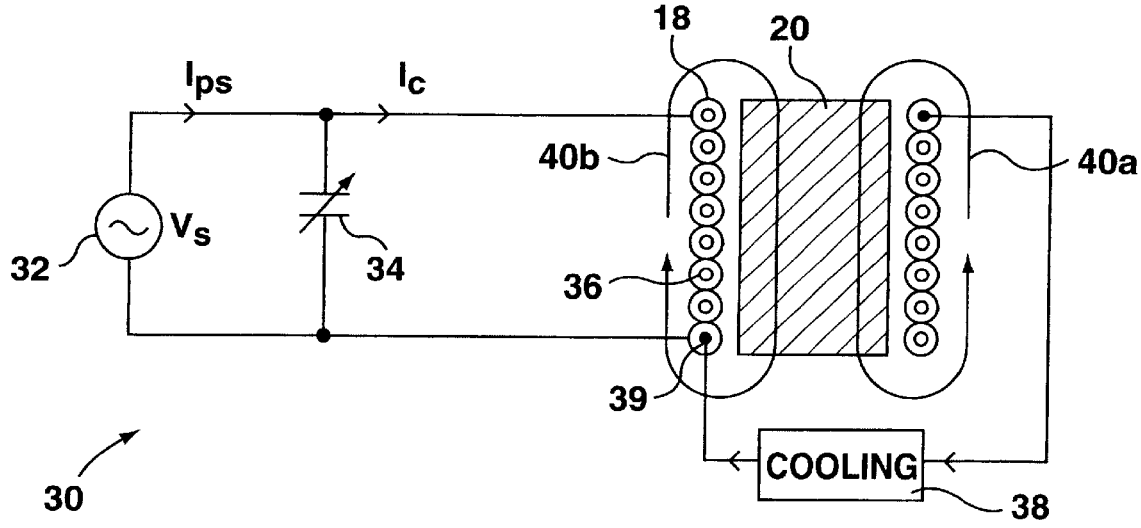
FIG. 2 (PRIOR ART)
FIG. 2 is a simplified schematic representation of inductive heating as known in the art.
Figure 3:
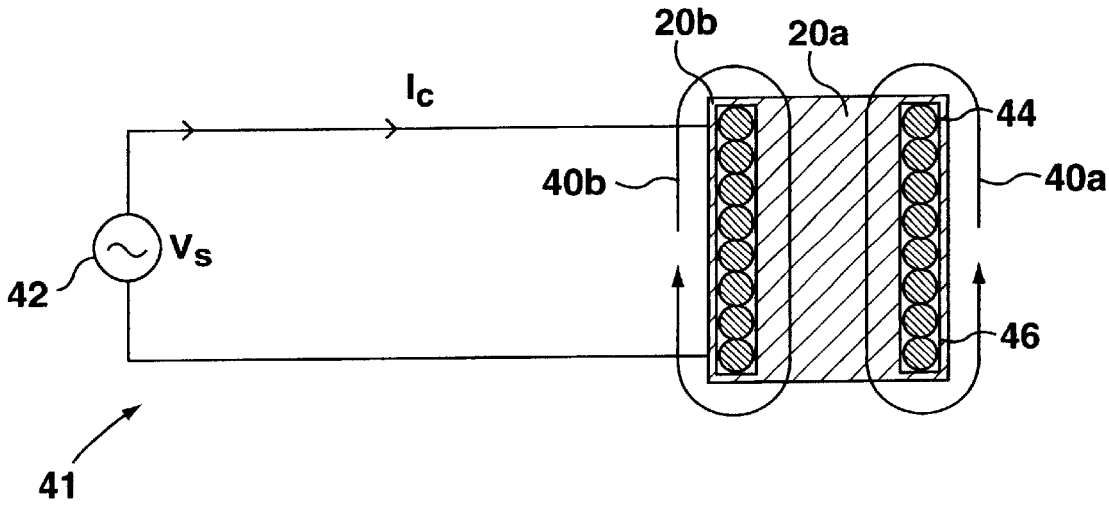
FIG. 3 is a partially schematic representation showing a heating element according to the present invention.
Figure 3A:
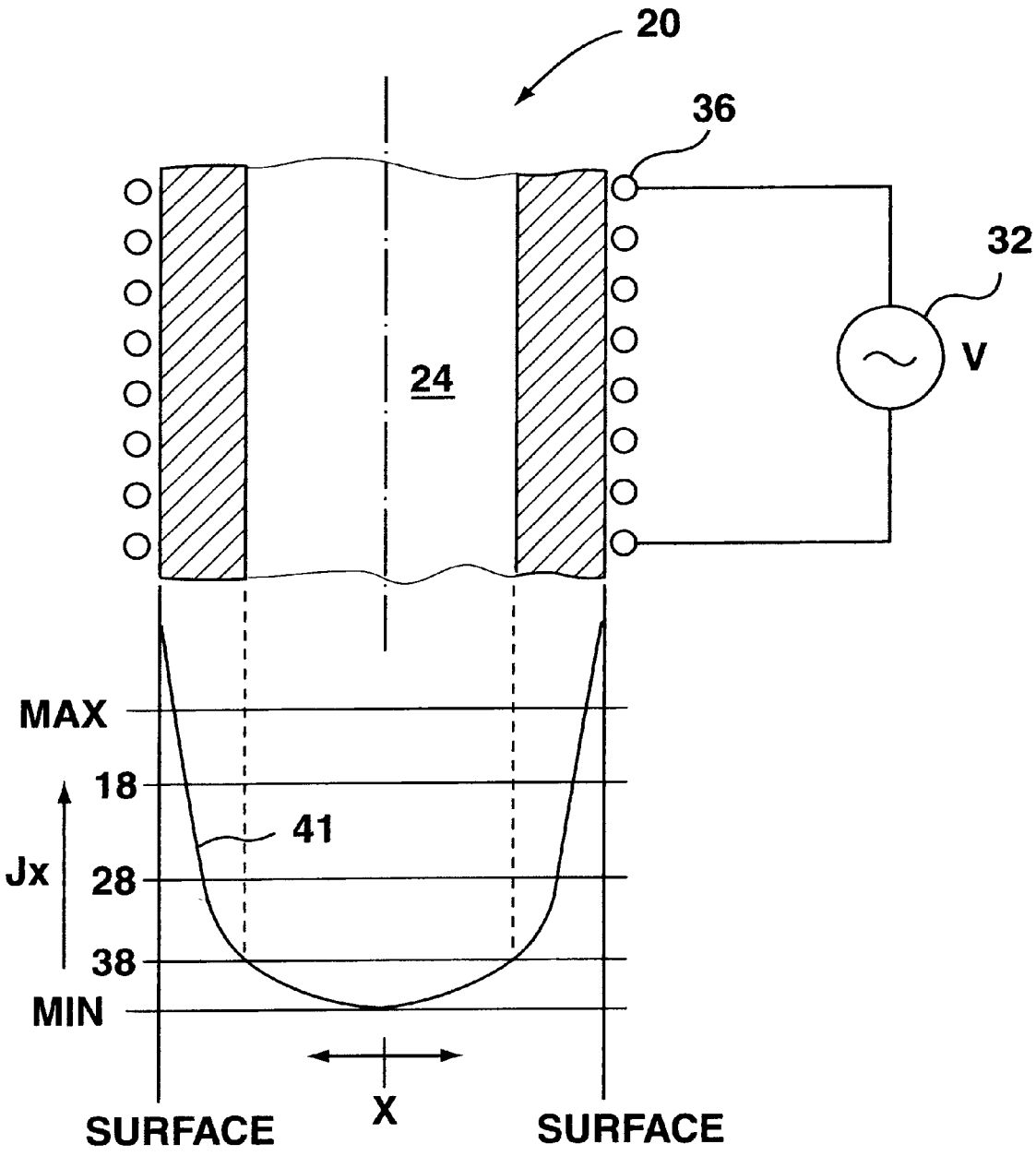
FIG. 3A is a graphical representation of the "skin effect" in the conductor of an induction type heater coil.

Referring to FIG. 3, a simplified schematic of an exemplicative embodiment 41 of the present invention is generally shown. A power supply 42 provides an alternating current to a heater coil 44 that is wrapped around and in communication with bodies 20*a* and 20*b*. In the preferred embodiment, and not by limitation, the coil 42 is placed within a groove 46 formed between bodies 20*a* and 20*b* which forms a closed magnetic structure. When an alternating current is applied to the coil 44, magnetic lines of flux are generated as shown by arrows 40*a* and 40*b*. It should be noted, that a plurality of magnetic lines of flux are generated around the entire periphery of the bodies, and the two lines shown, 40*a* and 40*b*, are for simplification. These magnetic lines of flux generate eddy currents in the bodies 20*a* and 20*b*, which generates heat in accordance with the skin-effect principles described previously. In the preferred embodiment, the body 20*a* and 20*b* can be optimally designed to maximize the magnetic lines of flux 20*a* and 20*b* to generate the most heat possible. In addition, the coil 44 is in thermal communication with the bodies 20*a* and 20*b* so that any resistive heat that is generated in the coil 44 is conducted to the bodies.

Figure 3B:
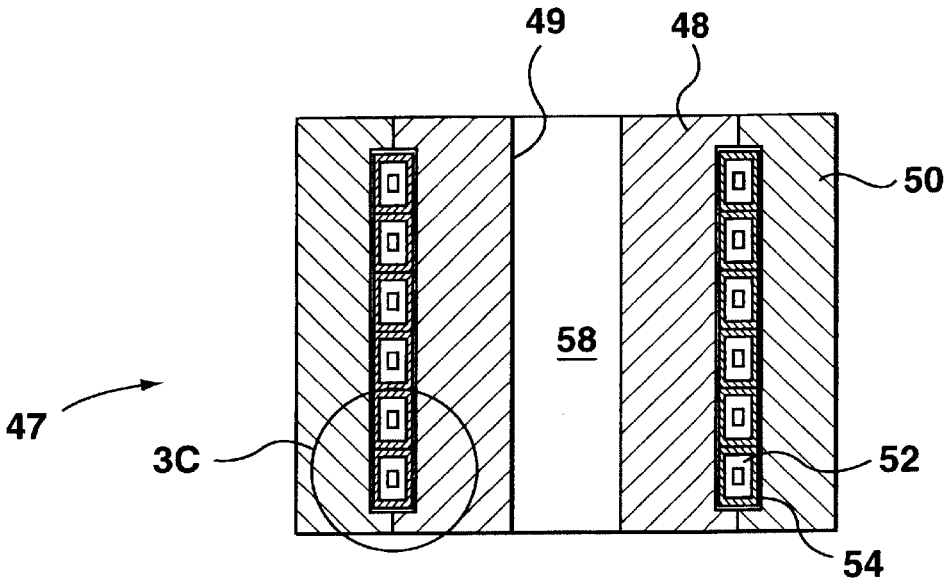
FIG. 3B is a cross-sectional view of a heating element according to the present invention.
Figure 3C:
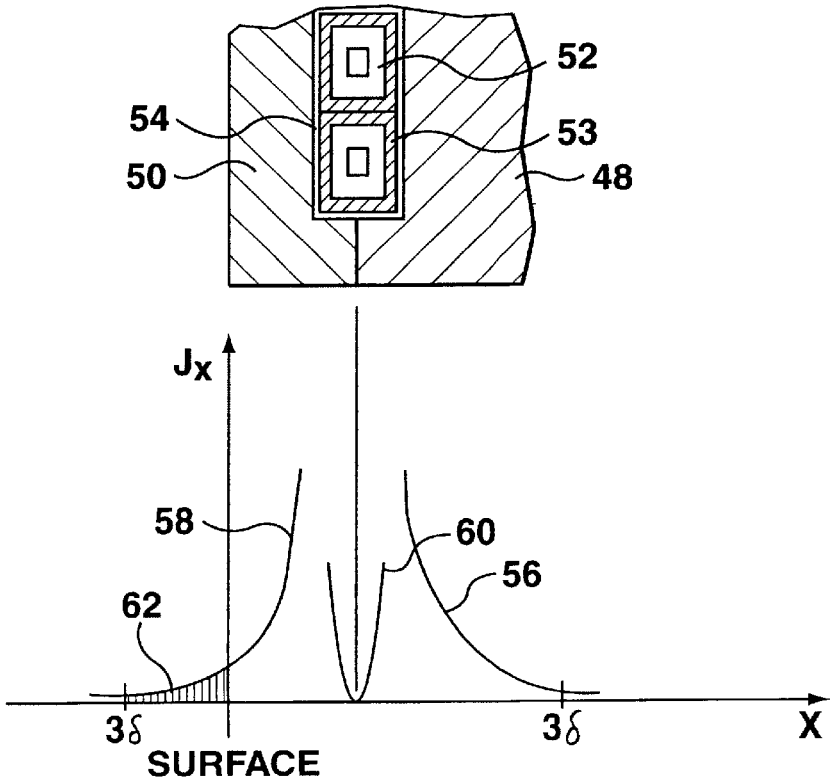
FIG. 3C is a cross-sectional enlarged view of the preferred embodiment according to the present invention showing the current density distribution in each component of the present invention.

Referring now to FIGS. 3B and 3C, another exemplicative preferred embodiment 47 of the present invention is generally shown. Although cylinders are primarily shown and discussed herein, it is to be understood that the use of the term cylinder or tube in this application is by no means to be limited to circular cylinders or tubes; it is intended that these terms encompass any cross-sectional shape. Furthermore, although the electrical circuit arrangements illustrated all employ direct or ohmmic connection to a source of electric power, it is to be understood that the invention is not so limited since the range of its application also includes those cases where the electric power source is electrically coupled to the heating element inductively or capacitively.

A heater coil 52 is wrapped in a helical fashion around a core 48. In the preferred embodiment, the heater coil 52 is made from solid metallic material like copper or other non-magnetic, electrically and thermally conductive material. Alternatively, the coil could be made from high resistance high temperature alloy. Use of the conductors with low resistance will increase inductive power rate that may be useful in some heating applications. One wire construction that can be used for low resistance coil is litz wire. Litz wire construction is designed to minimize the power losses exhibited in solid conductors due to skin effect. Skin effect is the tendency of the high frequency current to concentrate at the surface of the conductor. Litz construction counteracts this effect by increasing the amount of surface are without significantly increasing the size of the conductor. Litz wire is comprised of thousands of fine copper wires, each strand on the order of 0.001 inch in diameter and electrical insulation applied around each strand so that each strand acts as an independent conductor.

An inside wall 49 of the core 48 defines a passageway 58 for the transfer of a fluid or solid material which is to be heated. In the preferred embodiment, and by way of example only, the fluid material could be a gas, water, molten plastic, molten metal or any other material. A yoke 50 is located around and in thermal communication with the heater coil 52. In the preferred embodiment the yoke 50 is also made preferably (but not exclusively) from a ferromagnetic material. The coil 52 may be placed in a groove 54 that is provided between the core 48 and yoke 50. The core 48 and yoke 50 are preferably in thermal communication with the heater coil 52. To increase heat transfer between the heater coil 52 and the core or yoke, a suitable helical groove may be provided in at least the core or yoke to further seat the heater coil 52 and increase the contact area therein. This increased contact area will increase the conduction of heat from the heater coil 52 to the core or yoke.

An alternating current source (not shown) of a suitable frequency is connected serially to the coil 52 for communication of current therethrough. In the preferred embodiment, the frequency of the current source is selected to match the physical design of the heater. Alternatively, the frequency of the current source can be fixed, preferably around 50–60 Hz to reduce the cost of the heating system, and the physical size of the core 48 and/or yoke 50 and the heater coil 52 can be modified to produce the most efficient heater for that given frequency.

The application of alternating current through the heater coil 52 will generate both inductive and resistive heating of the heater coil 52 and create heat in the core 48 and yoke 50 by generation of eddy currents as described previously. The diameter and wall thickness of the core 48 is selected to achieve the highest heater efficiency possible and determines the most efficient coil diameter. Based on the method to be described hereinafter, the heater coil diameter is selected based on the various physical properties and performance parameters for a given heater design.

Referring to FIG. 3C, an enlarged cross-section of the heater coil 52 is shown with a graphical representation of the current density in the various components. The heater coil 52 is traversed along its major axis or length by a high frequency alternating current from the alternating current source. The effect of this current flow is to create a current density profile as shown in FIG. 3C along the cross section of the heater coil 106. As one skilled in the art will clearly see, the curves 58, 60 and 56 each represent the skin-effect within each of the components. For the coil 52, the coil exhibits a current density in the conductor cross section as shown in trace 60 that is a maximum at the outer edge of the conductor and decreases exponentially towards the center of the conductor.

Since the present invention places the heater coil 52 between the ferromagnetic core 48 and yoke 50, the skin effect phenomenon will also occur in these components. FIG. 3C shows the current density profile within a cross sectional area of the yoke and the core. As mentioned previously, for all practical purposes, all induced current is contained with an area along the skin of each component at a depth equal to 36. Curve 56 shows the current density that is induced in core 48. At a distance 36 from the center of the coil, essentially 100% of the current is contained in the core and acts to generate heat. Curve 58 however shows the current density in the yoke 50, where a portion of the current depicted by shaded area 62 is not contained in the yoke, and as such is not generating heat. This lost opportunity to generate heat energy reduces the overall heater efficiency.

For this method of heating, various parameters of the heater design can be analyzed and altered to produce a highly efficient heater. These parameters include:

$I_{coil}$=heater coil current n=number of turns of heater coil d=coil wire diameter $R_o$=heater coil radius I=length of coil $\rho_{coil}$=specific resistance of heater coil $c_{coil}$=specific heat of heater coil $Y_{coil}$=density of coil $h_y$=thickness of the outer tube $D_h$=melt channel diameter $\mu_{substrate}$=substrate magnetic permeability $c_{substrate}$=substrate specific heat $Y_{substrate}$=substrate specific density η—frequency of alternating current ΔT—temperature rise The electrical specific resistance of the coil ($\rho_{coil}$) and coil physical dimensions (n, d, $R_o$, l) are major contributors to the creation of resistive heat energy in the coil. Heretofore, the prior art considered this heat generation as unusable and used several methods to mitigate it. Firstly using Litz wire to reduce resistive heat generation and second to cool the coil with suitable coolant. As a result, heaters do not operate at peak efficiency.

With this in mind, the present invention harnesses all of the energy in the induction coil and harness this energy for process heating. To effectively transfer all of the energy of the coil to the process we will select the material and place the induction coil within the substrate at the optimal location (or depth) that will be based on an analysis of the process heating requirements, mechanical structure requirements, and speed of heating.

In a preferred embodiment of the present invention, as shown for example in FIG. 3B, the coil 52 material can be Nichrome, which has a resistance that is six times higher than copper. With this increased resistance, we can generate six times more heat than using copper coil as suggested in prior art. In pure induction heating systems, commonly used high frequency induction heating equipment would not be able to operate under increased heater resistance. Power supplies known today operate on minimum coil resistance which supports the resonant state of the heating apparatus. Typically, according to the prior art, an increase in coil resistance will significantly decrease the efficiency of the heating system.

The coil 52 must be electrically insulated from the core and yoke to operate. So, a material providing a high dielectric insulating coating 53 around the coil 52 must be provided. Coil insulation 53 must also be a good thermal conductor to enable heat transfer from the coil 52 to the yoke and core. Materials with good dielectric properties and excellent thermal conductivity are readily available. Finally, coil 52 must be placed in the intimate contact with the heated core and yoke. Dielectrics with good thermal conductivity are commercially available in solid forms as well as in forms of powders and as potting compounds. Which form of dielectric to use is up to the individual application.

Total useful energy generated by the coil 52 installed within the yoke and core is given by the following relationship:

$$P_{combo}Q_{(resistive)}+Q_{(inductive)}$$

$$P_{combo}=I_c^2R_c+I_{ec}^2R_{ec}$$

Where:

Q=heat energy $P_{combo}$=Rate of energy generated by combination of inductive and resistive heating $I_c$=total current in the heating coil $R_c$=Induction coil resistance $I_{ec}$=total equivalent eddy current in the heated article $R_{ec}$=equivalent eddy current resistance in heated Article The second part of the above equation is the inductive contribution as a result of the current flowing through the coil and inducing eddy currents in the core and yoke. Since the coil 52 is placed between the core 48 and the yoke 50, we have no coupling losses and therefore maximum energy transfer is achieved. From the energy equation it can be seen that the same coil current provides more heating power in comparison with pure resistive or pure inductive method. Consequently, for the same power level, the temperature of the heater coil can be significantly lower than compared to pure resistive heating. In contemporary induction heating all of the energy generated as ohmic losses in the induction coil is removed by cooling, as discussed previously.

In cases of structural part heating, reduction of thermal gradients in the part is important. Resistive and inductive heating generates thermal gradients and combination of both heating means reduce thermal gradients significantly for the same power rate. While resistive heating elements may reach a temperature of 1600° F., the heated article may not begin to conduct heat away into sub-surface layers for some time. This thermal lag results in large temperature gradients at the material surface. Significant tensile stress exists in the skin of the heated article due to dynamic thermal gradients. Similarly, induction heating only creates heat in a thin skin layer of the heated article at a high rate. These deleterious effects can be significantly diminished by combining together the two separate heating sources in accordance with the present invention which in turn results in evening out temperature gradients and therefore reducing local stress level.

Figure 4:
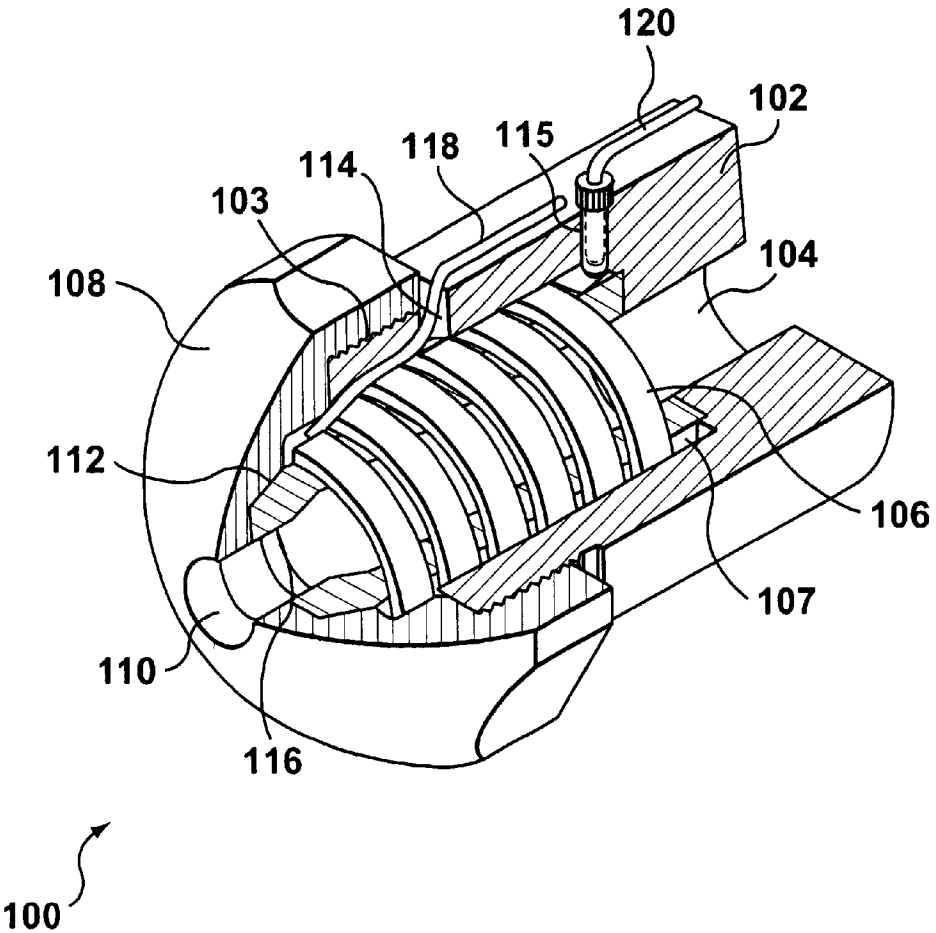
FIG. 4 is a partial cross-sectional isometric view of a preferred embodiment of the present invention.
Figure 4A:
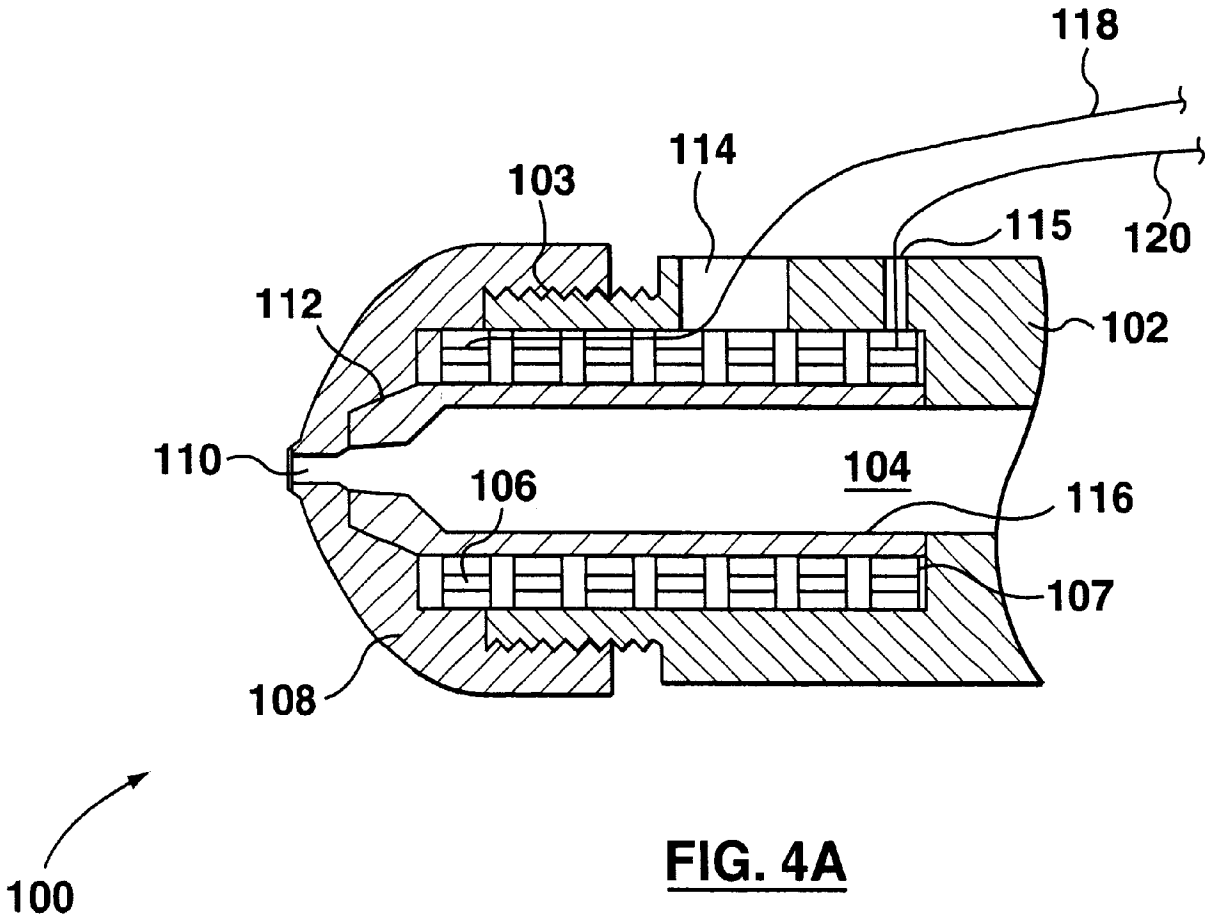
FIG. 4A is a cross-sectional view of the embodiment shown in FIG. 4.

Referring now to FIGS. 4 and 4A, another exemplicative preferred embodiment 100 of the present invention is generally shown. It should be noted, the current figures show a typical arrangement for injection molding metals such as magnesium, but numerous other arrangements for injection molding materials such as plastic could easily be envisioned with very little effort by those skilled in the art.

The heated nozzle 100 is comprised of an elongated outer piece 102 having a passageway 104 formed therein for the communication of a fluid. The fluid could be molten metal such as for example magnesium, plastic or other like fluids. In a preferred embodiment, the fluid is a magnesium alloy in a thixotropic state. In a preferred embodiment, threads 103 are provided at a proximal end of the outer piece 102 which interfaces with threads formed on a nozzle head 108. Nozzle head 108 is rigidly affixed to the outer piece 102 and an inner piece 116 is inserted between the head 108 and the outer piece 102. The passageway 104 continues through inner piece 116 for communication of the fluid to an outlet 110. An annular gap 107 is provided between inner piece 116 and outer piece 102 for insertion of a heater coil 106. In this preferred embodiment, a taper 112 is provided between the nozzle head 108 and the inner piece 116 to insure good mechanical connection. Electrical conductors 118 and 120 are inserted through grooves 114 and 115 respectively for connection to the heater coil 106. The heater coil 106 is preferably provided with an electrically insulative coating as described previously.

As shown by the figures, with this arrangement, the heater coil 106 has been sandwiched between a ferromagnetic inner piece 116 and a ferromagnetic outer piece 102 which forms a closed magnetic circuit around the coil. Preferably, the heater coil 106 is in physical contact with both the inner piece 116 and the outer piece 102 for increased heat conduction from the coil. But a slight gap between the heater coil 106 and the inner and outer piece would still function properly.

In the preferred embodiment, alternating current is communicated through the heater coil 106 thereby generating inductive heat in the outer piece 102 and the inner piece 116 and the nozzle head 108 as well. Current flowing through coil 106 will also create resistive heat in the coil itself which will be conducted to the inner and outer pieces. In this arrangement, little or no heat energy is lost or wasted, but is directed at the article to be heated.

Referring now to FIG. 6, which shows a table comparing the various design criteria for each method of heating previously discussed. From this table, the reader can quickly appreciate the advantages associated with using the method of heating in accordance with the present invention. According to the present invention, more heat energy is generated with less energy loss without the use of auxiliary cooling and without the use of a resonance filter. As a result, the time to heat up a given article is less and is achieved in a more controlled manner depending on the heater coil design.

What is claimed is:

1. A method for heating an article comprising the steps of:

providing a coiled electrical conductor in thermal and magnetic communication with said article;

closing a magnetic circuit around said coiled electrical conductor;

supplying power to said coiled electrical conductor to produce inductive heat in said article and resistive heat in said coiled electrical conductor; and directly transferring substantially all the resistive heat generated in said coiled electrical conductor to said article.

2. The method according to claim 1, wherein the magnetic circuit is closed by making the article in at least two portions, the at least two portions including an inner portion and an outer portion, the coiled electrical conductor being disposed between the inner and outer portions and coiled around the inner portion.

3. The method according to claim 2 wherein said inner and outer portions are made from a ferromagnetic material.

4. The method according to claim 2, wherein, in use, a current induced in said article has a penetration depth, and wherein said outer portion has a wall thickness substantially equal to or greater than the penetration depth.

5. The method according to claim 1, wherein said coiled electrical conductor is made from a material having a resistance higher than that of copper.

6. The method according to claim 5, wherein said material is nichrome.

7. The method according to claim 1, wherein the step of providing an electrical conductor in thermal and magnetic communication with said article is accomplished by providing a helical groove in said article and installing said electrical conductor in said groove.

8. The method according to claim 1 wherein said conductor has no internal cooling capacity.

9. The method according to claim 1, wherein, in use, a current induced in said article has a penetration depth, and further comprising the step of placing said electrical conductor in said article at a depth substantially equal to or greater than the penetration depth.

10. The method according to claim 1, wherein said electrical conductor is made from a semiconductor material.

11. The method according to claim 1, wherein the step of applying a current to said electrical conductor is performed inductively.

12. The method according to claim 1, wherein said electrical conductor is electrically insulated from said article.

13. The method according to claim 1, wherein said resistive heat in said electrical conductor is conducted to said article at a rate sufficient to preclude the use of an auxiliary cooling means for said conductor.

* * * * *

UNITED STATES PATENT AND TRADEMARK OFFICE

CERTIFICATE OF CORRECTION

PATENT NO. : 6,781,100 B2
DATED : August 24, 2004
INVENTOR(S) : Pilavdzic et al.

It is certified that error appears in the above-identified patent and that said Letters Patent is hereby corrected as shown below:

Title page,
Item [*] Notice, delete the phrase “by 0 days” and insert -- by 331 days --.

Signed and Sealed this

Twenty-fifth Day of October, 2005

JON W. DUDAS
*Director of the United States Patent and Trademark Office*